United States Patent [19]

Muise

[11] Patent Number: 5,002,224

[45] Date of Patent: Mar. 26, 1991

[54] PRODUCE CONTAINER

[75] Inventor: Herbert D. Muise, Olympia, Wash.

[73] Assignee: Weyerhaeuser Company, Tacoma, Wash.

[21] Appl. No.: 522,762

[22] Filed: May 11, 1990

[51] Int. Cl.[5] ..... B65D 5/20

[52] U.S. Cl. ..... 229/169; 229/160; 229/918; 229/DIG. 11

[58] Field of Search ..... 229/160, 169, 918, 919, 229/DIG. 11, 177

[56] References Cited

U.S. PATENT DOCUMENTS

| | | | |
|---|---|---|---|
| 3,534,900 | 10/1970 | Hutchins | 229/919 |
| 4,058,249 | 11/1977 | Buck | 229/DIG. 11 |
| 4,266,714 | 5/1981 | Crane | 229/DIG. 11 |
| 4,770,339 | 9/1988 | Weimer | 229/918 |
| 4,826,074 | 5/1989 | De Paul | 229/169 |
| 4,860,948 | 8/1989 | Hofstede | 229/918 |

*Primary Examiner*—Gary E. Elkins

[57] ABSTRACT

A corrugated produce container is formed from a single piece of suitably cut and scored corrugated packaging material. The container has a bottom, two side walls and multi-ply end panels. Suitable stacking tabs may be provided and the top closure panels can be folded over the stacking tabs. Hinged to each wide end panel is a multi-part reinforcing end panel having a first portion extending in the vertical direction and having a top member hinged thereto which is folded over and has one edge thereof sized to overlie the top edge of the end panel. Hinged to this portion is another vertically extending reinforcement member and hinged on the opposite side of it is the major reinforcement end panel. Suitable hand holds and ventilation apertures can also be provided.

2 Claims, 3 Drawing Sheets

PRODUCE CONTAINER

BACKGROUND OF THE INVENTION

The present invention relates generally to produce shipping containers and more particularly to single piece corrugated shipping containers having multi-ply end panels and a particular improvement for strength and stacking enhancement purposes. There are many single piece cut and scored paperboard blands useful for erecting into produce containers. One of the problems with the known prior art containers is their stacking strength and stability. The present invention attempts to overcome such problems with improved results.

Per the foregoing, one object of the present invention is to provide a single piece corrugated produce container which has enhanced stacking strength when a plurality of containers are stacked atop one another.

Another objects is to provide such improved strength with a minimal amount of additional material.

These and other objects will become apparent upon reading the specification to follow in conjunction with the attached drawings.

SUMMARY OF THE INVENTION

Briefly stated, the present invention is practiced by providing an additional vertical section within one of the reinforcing end panels which has a hinged top portion and during erection of the container, such top portion is folded 90 ° to lie horizontally with one end portion overlying the corresponding top edge of the wide end panel. In addition, the single piece container is typical in that it has a bottom, two side walls, top closure panels and a pair of single opposed wide end panels. Hinged outwardly from the vertical edges of the single wide end panels are multi-part reinforcing end panels within which is the vertically extending section having the hinged tab to provide the present improvement.

DESCRIPTION OF THE PREFERRED EMBODIMENT

Figure 1:
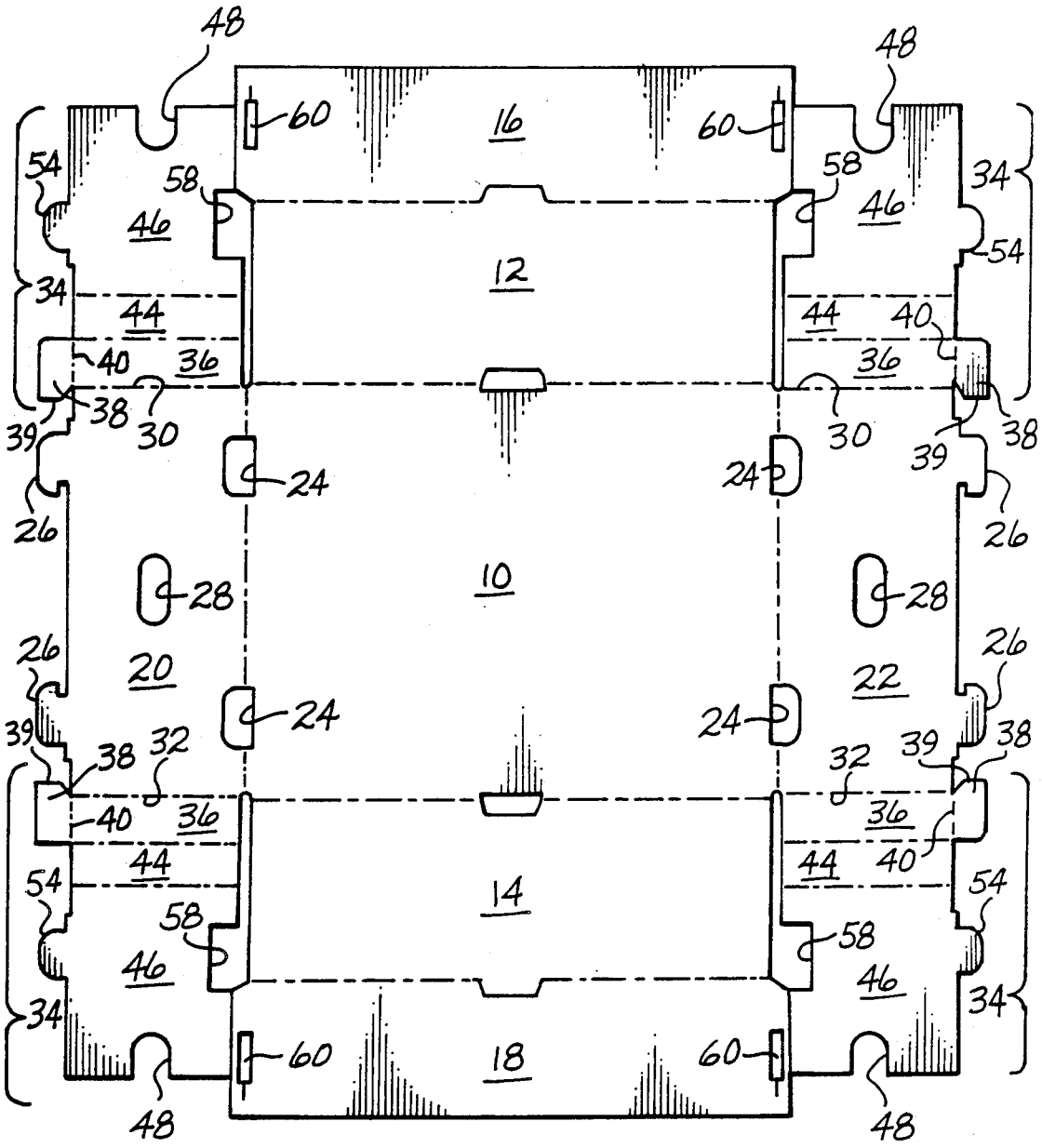
FIG. 1 is a plan view showing the single piece corrugated blank with its score lines and die cut lines defining the component panels.

Referring first to FIG. 1, the single piece corrugated blank has a bottom panel 10 and hinged on opposite sides thereof a pair of side panels 12, 14. Hinged along the top edges of the side panels are the top closure panels 16, 18. Extending outwardly from bottom panel 10 along the side edges and hinged thereto are the full width end panels 20, 22. Located to one another and partially within bottom panel 10 and partially within side panels 12, 14 are apertures each indicated at 24 which are sized to accommodate tab 26 which extends upwardly from a side panel when the container is erected. As will be well understood by those skilled in the art, tabs 26 are stacking tabs which fit within apertures 24 when a plurality of erected containers are stacked one atop another.

Within the full width end panels 20, 22 are opposed hand hold apertures, each indicated at 28. Extending outwardly from each side edge 30, 32 of a respective end panel and hinged thereto through a typical score line is a multi-part reinforcement end panel indicated generally at 34. The first portion 36 is a relatively narrow panel which will be in a vertical orientation when the container is erected and which will extend substantially the full vertical height of the end panel. Extending outwardly from the top edge of first panel 36 is tab member 38. Tab member 38 is hinged to first panel 36 at score line 40. Tab 38 is substantially rectangular in shape but has an extension 39 on one end thereof to overlie a top edge of its adjacent full width end panel when in the erected state.

The next panel portion or second panel 44 is hinged to first panel 36 and extends outwardly a dimension substantially equal to the dimension of first panel 36. When the container is erected and all panels bonded together, the first and second panels 36, 44 are bonded together and form a vertically upstanding reinforcement member adjacent a corner portion of side panels 12, 14.

Extending further outwardly from second panel 44 is the major reinforcement panel 46. The panel 46 has a width dimension which is approximately equal to one-half the width dimension of end panels 20, 22. Along the outer edge of reinforcement panels 46 is half of a hand hold aperture each indicated at 48 and when the container is erected, corresponding half hand holds will oppose one another and underlie the full hand hold apertures 28. Along the outer top edges of full width end panels 20, 22 are the opposed stacking tabs 26. On each major reinforcement panel 46 along the top outer edge is a corresponding cooperating stacking tab portion 54. When the container is in the erected state and containers are stacked one atop another, the cooperating stacking tabs will extend into the cooperating stacking tab apertures. Positioned within and along the bottom edge of each reinforcement panel 46 is a generally rectangular cutout portion 58 which is dimensioned to accommodate an upwardly extending stacking tab.

Figure 3:
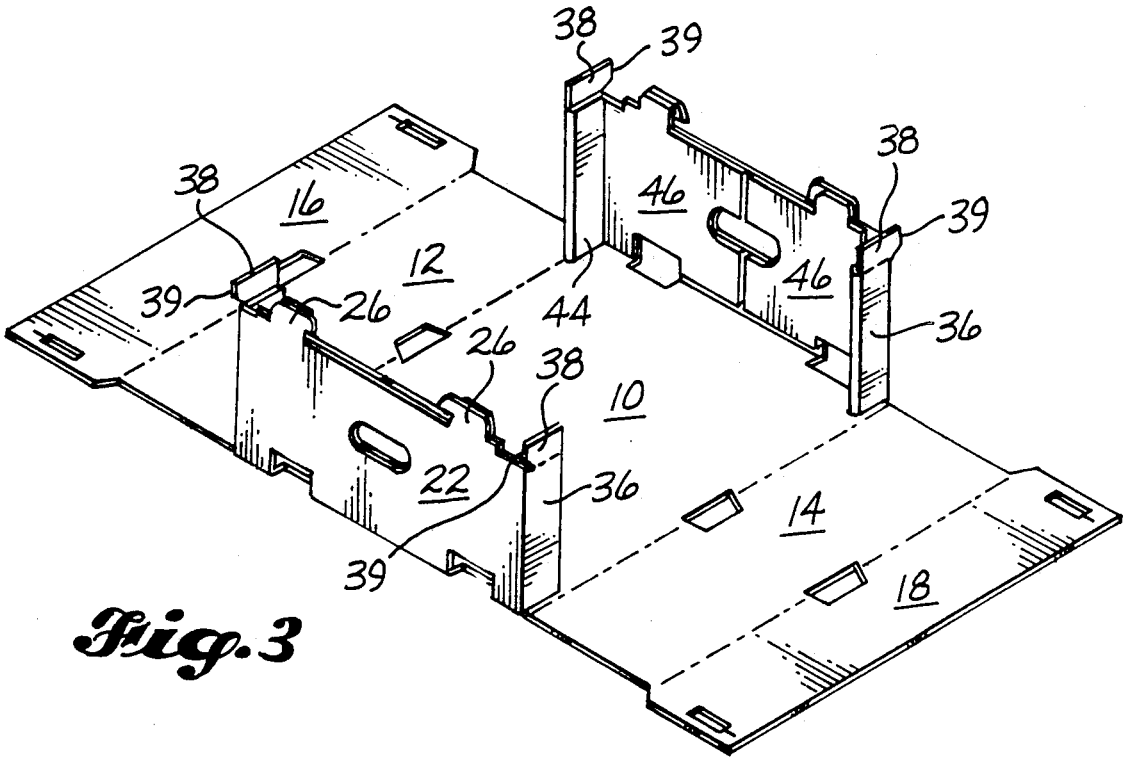
FIG. 3 is also a view in a partially erected state showing the reinforcing panels in their vertical orientation before the side panels are folded upwardly.
Figure 4:
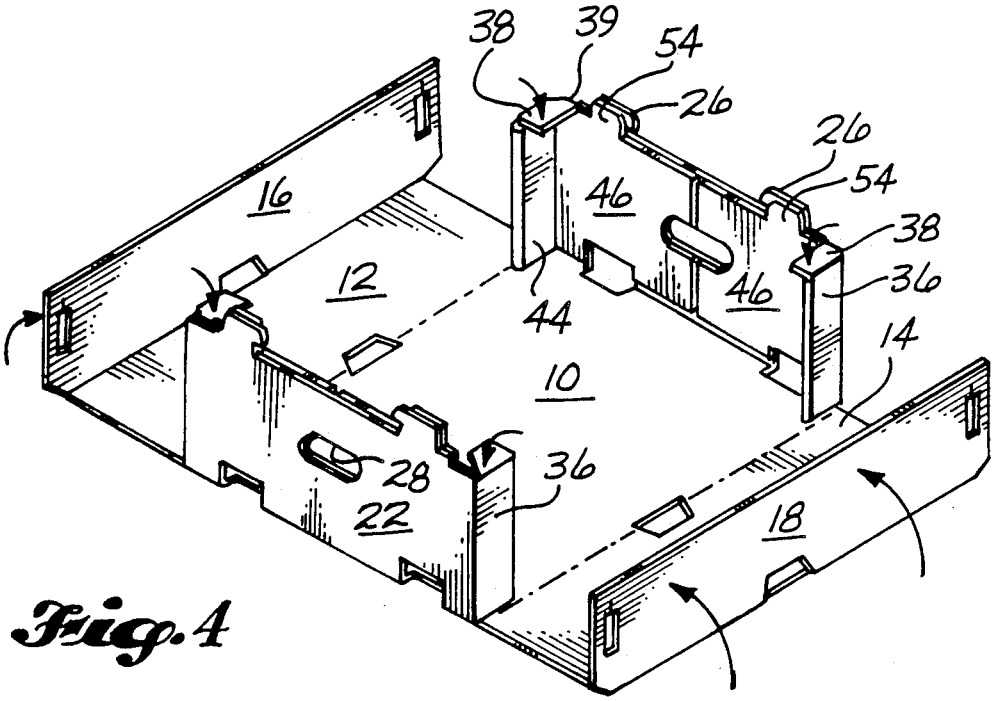
FIG. 4 is a view similar to FIG. 3 but showing the top portion on the vertical section being folded to the horizontal position.
Figure 5:
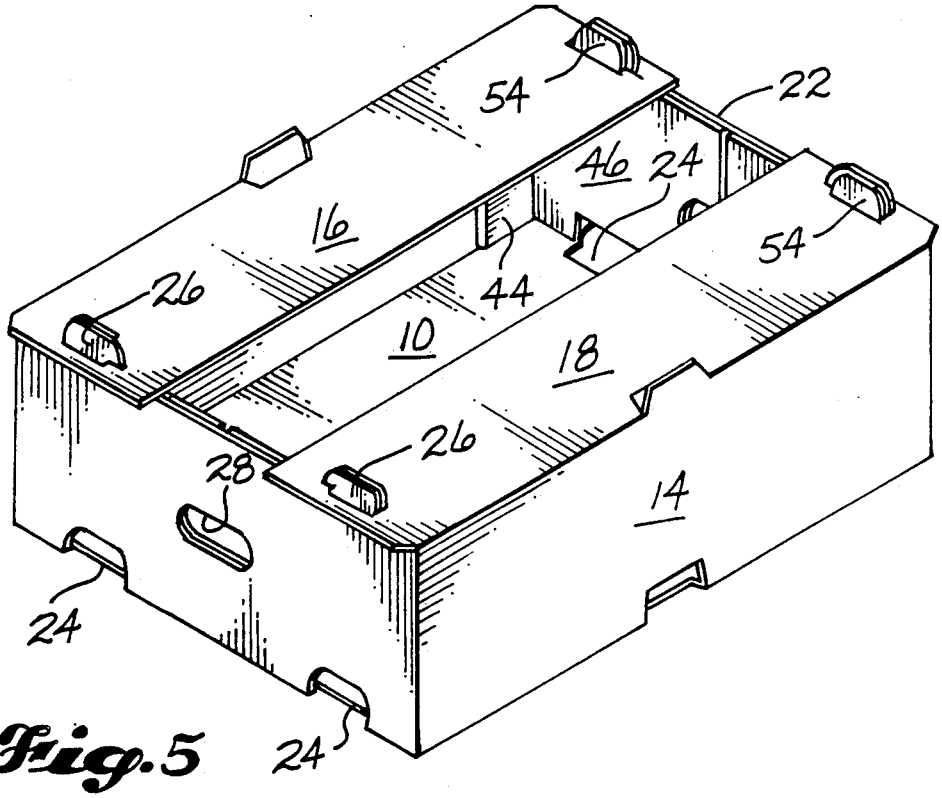
FIG. 5 is an isometric view showing the container of the present invention in its erected state with the closure panels in place.
Figure 2:
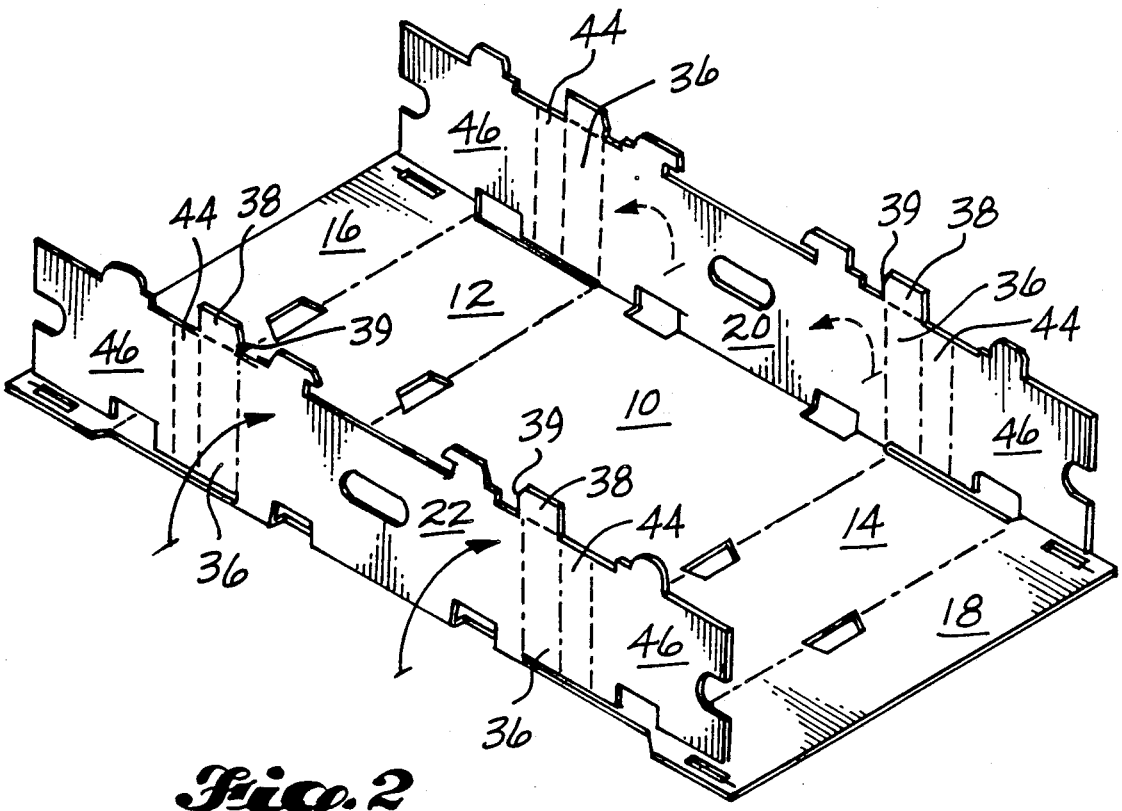
FIG. 2 shows the blank in a partially erected state.

Turning now to FIGS. 2–5, the erection sequence will be described as will the cooperation among individual container panels. First, the end panel sections are folded upwardly 90° and the first and second panel portions 36, 44 as well as the reinforcement panels 46, are adhesively bonded to adjacent surfaces. First panel 36 will be bonded to second panel 44 as shown in FIG. 3 and then caused to extend outwardly at a 90° angle to the end panels. The reinforcement panels 46 will be bonded to the opposing inside surface of the full width end panel. As may be seen, the hand holds are neatly formed as are the upwardly extending stacking tabs and the stacking tab cutout portions. The tab 38 is shown in the vertically extended position in FIG. 3. Now the side panels 12, 14 will be rotated upwardly 90° and bonded to the outer vertically extending surfaces of first panels 36. The tabs 38 will be left unbonded and free to be rotated downwardly 90°. While it is not absolutely essential to adhesively bond the panel members together, it is the preferred method. At this point the formed container will be packed with whatever produce is selected, such as tomatoes, and the top closure panel 16, 18 folded over the 90° to lay horizontal. The panels are locked in place with the cooperating opposed apertures 60 being locked into corresponding slots within the stacking tabs. As the closure panels 16, 18 are folded over, they will cause each tab member 38 to also rotate approximately 90° to a horizontal orientation and each extension portion 39 will then abut a portion of the top edge along the erected multi-ply end panel. It is tab 38 and its extension portion 39 resting atop the edge of the end panel that provides additional strength to the erected and closed container. When a plurality of packed containers are stacked one atop another, they have enhanced stacking strength and better resistance to other forces common in the shipment of produce to the marketplace.

Thus, what has been described is a substantial improvement in a single piece corrugated produce container whereby strength enhancement is possible with very little additional material.

While a detailed description of the preferred embodiment has been given, modifications and changes may occur to those skilled in the art. All such changes and modifications are intended to be included within the scope of the appended claims.

I claim:

1. A container having a bottom, side walls, top closure flaps and end walls for holding produce or the like, having the improvement comprising:

at least one relatively narrow panel hinged to the end of an end wall and oriented in a substantially vertical orientation and resting adjacent a portion of the side wall and a tab member located atop the narrow panel and hinged thereto having an extension member thereon adapted to overlie a portion of the top edge of the adjacent end panel when it is folded downwardly.

2. The container of claim 1 in which the narrow panel is adhered to the side wall.

* * * * *